United States Patent [19]

Little

[11] 4,422,774

[45] Dec. 27, 1983

[54] METAL FINISHING BARREL APPARATUS

[75] Inventor: Frank Little, Au Gres, Mich.

[73] Assignee: The Harshaw Chemical Company, Cleveland, Ohio

[21] Appl. No.: 246,010

[22] Filed: Mar. 20, 1981

[51] Int. Cl.[3] ..... B01F 9/02; B01F 15/02

[52] U.S. Cl. ..... 366/347; 204/213; 414/411

[58] Field of Search ..... 414/787, 411, 414, 684.3, 414/164; 212/166; 220/211, 229, ; 53/381 A, 50; 204/213; 366/347, 188

[56] References Cited

U.S. PATENT DOCUMENTS

| | | | |
|---|---|---|---|
| 2,182,494 | 12/1939 | Lavely | 212/4 |
| 2,335,867 | 12/1943 | Lavely | 414/684.3 |
| 3,302,608 | 2/1967 | Coons et al. | 366/347 |
| 4,154,538 | 5/1979 | Linnhoff et al. | 366/188 |

FOREIGN PATENT DOCUMENTS

| | | | |
|---|---|---|---|
| 1446648 | 6/1966 | France | 366/347 |

*Primary Examiner*—Bruce H. Stoner, Jr.

*Assistant Examiner*—James E. Barlow

*Attorney, Agent, or Firm*—Watts, Hoffman, Fisher & Heinke Co.

[57] ABSTRACT

A barrel loading and unloading station that includes a barrel support stand 10 for supporting a plating barrel 18 in predetermined positions and a door handling apparatus 14 for releasing and separating a barrel access door 16 from the plating barrel. The door handling apparatus 14 includes a door assembly 40 mounted for reciprocating motion towards and away from the plating barrel by a pair of trackways 42 that are mounted to an elevator mechanism 44 that is operative to raise and lower the trackways to increase accessibility to the barrel after the access door has been removed. One embodiment of the door handling assembly 40 includes a pair of rotatable spindles 56 operative to engage and rotate locking knobs 220 on the barrel access door 16 and a slide mechanism 120 for unlatching the door from the barrel. Another embodiment of the door handling assembly 40' includes a plurality of clamp engaging spreader arms 366 operative to spread and release resilient clamps 352 from the plating barrel.

17 Claims, 14 Drawing Figures

METAL FINISHING BARREL APPARATUS

DESCRIPTION

1. Technical Field

The present invention relates generally to automated metal finishing processes, such as plating, phosphating, chemical brightening, washing and similar operations, in which parts are processed in a liquid bath, and more specifically to an apparatus for facilitating the loading and unloading of a container used to carry the parts through the metal finishing process.

2. Background Art

In conventional metal finishing processes such as those mentioned above, one or more containers usually termed "barrels," containing parts to be processed, are carried along a conveyor system and are submerged in a variety of solutions for predetermined lengths of time. The conveyor system for transporting the barrels through the process usually comprises either an overhead hoist or a "return barrel machine." A driving arrangement either forming part of the conveyor system or mounted to the solution tanks, is coupled and imparts rotation to, the barrel. The metal finishing process usually begins at a loading and unloading station at which an operator removes an access door from the barrel, empties the finished parts into a suitable container and then refills the barrel with parts to be processed.

A variety of barrel configurations are presently being used by industry today. In general, a barrel comprises a plurality of perforate walls that are joined and arranged to define a generally cylindrical body that extends between circular end caps. At least one wall panel is usually removable and forms the access door through which the barrel is loaded and unloaded. The barrel itself is constructed of a material such as polypropylene, etc. that is able to resist the corrosive effects of the solutions encountered in the particular finishing process.

The barrel access doors are usually secured to the barrel in one of two ways. In one type of barrel, the access door merely overlies the opening and C-shaped resilient clamps are placed across the transverse dimension of the door and engage structure located on the wall panels immediately adjacent the barrel opening. To gain access to the interior of the barrel, the operator releases and removes the clamps and then lifts the door off the barrel.

In another type of barrel, the barrel door is an assembly that includes a locking member that is moved into locking engagement with locking structure located on either side of the barrel opening. The access door additionally includes one or more knobs that are rotated to fix the position of the locking member in either the locked or unlocked position. Examples of this type of barrel access door can be found in U.S. Pat. Nos. 3,507,529, 3,583,739 and 3,653,700 which are owned by the assignee of the present application. In order to gain access to the interior of this type of barrel, the operator rotates the locking knobs to release the locking member, slides the locking member to its unlocked position, and lifts the door from the barrel opening.

With either type of barrel door, considerable operator effort is expended in loading and unloading the barrel. Due to the fatiguing nature of the operation, a plurality of operators is typically needed during the course of a single work day. Moreover, it has been found that the doors experience considerable damage when handled by careless operators, necessitating premature replacement or repair at considerable cost.

DISCLOSURE OF THE INVENTION

The present invention provides a new and improved apparatus that facilitates the loading and unloading of a metal finishing barrel. For purposes of illustration the invention shall be described in connection with a plating process. It should be understood, however, that the features of the invention are equally applicable to other metal finishing processes, including phosphating, chemical brightening, washing, and the like.

The preferred embodiment of the invention virtually eliminates the need for an operator to remove and replace the barrel access door because the apparatus includes an arrangement which first releases the door and then separates the door from the barrel and conveys it to a position that is spaced from the barrel opening thereby enabling the barrel to be loaded by either a separate loading device or manually by an operator. The disclosed door handling apparatus can be adapted to operate with a variety of access door configurations and will handle doors that include a slidable locking member as well as doors that are secured to the barrel by resilient clamps.

Improved barrel door constructions are also disclosed by the present invention which enhance the operation of the door handling apparatus. The improved door constructions include a door that utilizes sliding lock plates to engage locking structure formed on the barrel as well as a door that employs resilient clamps to maintain door closure.

In accordance with the invention, a plating barrel loading and unloading station is disclosed at which a barrel is positioned in alignment with the door handling apparatus. In some, if not many applications, the barrel conveyor system, i.e., return barrel machine, can serve as the means for positioning the barrel. For those applications in which the conveyor system cannot serve this function, the present invention provides a barrel support stand on which a barrel assembly is placed by the conveyor system i.e., an overhead hoist. The support stand preferably includes a drive mechanism for rotating the barrel to a pedetermined position with respect to the door handling apparatus. In the preferred embodiment, the drive mechanism is also used to rotate the barrel to unload or dump its contents into a suitable receptacle, once the access door has been removed. In those applications not requiring the barrel support stand, the conveyor system would be used to rotate the barrel for unloading purposes.

The door handling apparatus comprises a door handling assembly mounted for reciprocating movement by a pair of trackways. When driven to its extended position, the door handling assembly is engageable with the access door on the barrel and is operative to release door securing devices. When driven to the retracted position, the door assembly moves away from the barrel and in the preferred embodiment, this movement separates the barrel access door from the barrel. A double acting, fluid pressure actuator preferably effects the requisite movements in the door handling assembly.

In the illustrated embodiment, the trackways that support the door handling assembly are oriented at an angle of 45° from the vertical and are fastened to an elevating mechanism that is operative to raise and lower the trackways and hence the door handling assembly, with respect to the barrel support stand. The elevator comprises a pair of carriage assemblies which each support elevator arms that mount the trackways. The carriage assemblies move along rigid, vertical uprights which include guideways that engage the carriage assemblies. When the door handling assembly is driven to its lowermost position along the trackways, it is engageable with the access door. When driven to its uppermost position, it is spaced from the barrel and is in its retracted position.

The elevating feature of the present invention, increases the accessibility to the barrel after the access door has been removed and thus facilitates the loading of the barrel. Moreover, the elevating mechanism allows the door assembly to be positioned at a variety of operating levels in order to remove and replace access doors on barrel assemblies that include stacked barrels.

Two preferred embodiments of the door handling assembly are disclosed. In one embodiment, the door handling assembly is specifically adapted to remove and replace barrel access doors that include a slidable latch plate for securing the door to the barrel. In this embodiment, the door handling assembly includes a pair of rotatable spindles, each mounting a clamping arrangement including a pair of pivotally attached clamp members. When the assembly is driven to its door engaging position, the clamp members are actuated to clamp locking structure forming part of the access door. The spindles, which mount the clamp members, are then rotated to release the latch plate, held in position by the locking structure. The door latch plate is then moved laterally by a slide mechanism carried by the door handling assembly, preferably fluid pressure operated, and located between the spindles and engageable with an actuating member attached to the latch plate. Once the latch plate has been moved to its unlocked position, the door handling assembly actuator is energized to move the assembly to its retracted position (away from the barrel) while maintaining the engagement between the spindle mounted clamp members and the locking structure on the barrel door, thus separating the door from the barrel.

With minor modifications, the door handling assembly disclosed in this embodiment can be used to remove and replace a variety of barrel access doors that include slidable latch plates including the access doors disclosed in U.S. Pat. Nos. 3,507,529, 3,583,739 and 3,653,700. Those skilled in the art, will recognize that additional spindles and clamp members as well as changes in the latch plate slide mechanism would have to be made in order to adapt the door handling assembly to a specific barrel construction. However, the fundamental features of the invention disclosed herein would not change and any such modifications are contemplated by this invention.

In order to enhance the overall function of the door handling apparatus, an improved barrel access door is disclosed that facilitates the operation of the door handling assembly. The improved barrel access door comprises a closure panel having a plurality of circulation holes extending therethrough, and a pair of latching plates, overlying a face of the closure panel and mounted for sliding movement towards and away from each other. Each latching plate includes a plurality of spaced, rigid tongues disposed along opposite sides of the plates that are engageable with locking structure formed in longitudinal ribs located along two sides of the barrel access opening. In the preferred embodiment, the latching plates engage the barrel locking structure when the plates are moved outwardly that is, away from each other, and disengage the locking structure when the plates are moved inwardly i.e., towards each other.

Each latching plate also includes an actuating member that is drivingly engageable by the slide mechanism mounted to the door handling assembly. A longitudinal slot formed in the bottom of each latch plate slidingly engages a raised track mounted on the closure panel and prevents skewed motion in the latching plates. In the preferred embodiment, a locking knob associated with each latching member extends through a slot formed in each latching plate and threadedly engages the closure panel. The knobs are rotated to clamp the latch plates relative to the closure panel in either their locked or unlocked positions.

According to another embodiment of the invention, a door handling assembly is disclosed for use with barrels that employ resilient clamps for securing and maintaining the closure of the access door. The disclosed door handling assembly includes apparatus for engaging, spreading and subsequently removing the resilient clamps from the barrel. The door handler of this embodiment like the previous embodiment includes an assembly mounted for reciprocating movement towards and away from the barrel support stand. The assembly is preferably driven to its clamp engaging position by an actuator similar to that used in the first embodiment. The assembly mounts a clamp spreading apparatus which moves into an aligned relationship with the door securing clamps as the assembly reaches its extended, clamp engaging position. Once this position is reached, the spreader mechanism engages and spreads the securing clamps thereby releasing the clamps from the barrel. The assembly is then driven to its retracted position, thereby removing the door clamps. Like the first embodiment, the assembly is preferably mounted to an elevator which supports the assembly for movement along a second path, preferably a vertical path, to provide added accessibility for loading and unloading the barrel.

In accordance with this embodiment, an improved barrel door is disclosed which enhances the operation of the disclosed door handling assembly. According to this feature, the securing clamps are attached to and form part of the access door so that the release and removal of the retaining clamps by the spreader arms effects separation of the access door from the barrel.

In the exemplary embodiment, the actuators forming part of the door handling apparatus are operated pneumatically by a pneumatic control system. In accordance with this feature, the spindles that mount the knob engaging clamp members are rotated through a predetermined arc of rotation by double acting pneumatic actuators suitably connected to the spindles through a moment arm. In order to prevent overstressing of the locking knobs, an arrangement for limiting the torque exerted by the spindles on the control knobs is provided. In the preferred embodiment, the arrangement takes the form of a regulator which limits the maximum pressure applied to the spindle actuator used to rotate the spindle arms in the locking direction. Once a preset air pressure (corresponding to the maximum torque desired) is applied to the spindle actuator, a further increase in pressure is inhibited regardless of the maximum pressure available from the source. In this way, the maximum torque applied to the locking knobs is controlled to prevent excessive rotation in the knobs by the spindles that would produce deformation or damage to the members of the locking knobs that engage the closure panel. Although the disclosed apparatus is preferably operated by pneumatic actuators, it should be understood that servo-mechanical devices for effecting movement in the various members are also contemplated.

The apparatus disclosed by the present invention greatly automates the process while at the same time enhancing the reliability of the barrel access door. The number of operators needed to carry out the process is reduced and more importantly the apparatus lends itself to further process automation in that it can be easily adapted to automatic barrel loading and unloading apparatus.

Additional features and a fuller understanding of the present invention will be obtained in reading the following detailed description made in connection with the accompanying drawings.

BEST MODE FOR CARRYING OUT THE INVENTION

Figure 1:
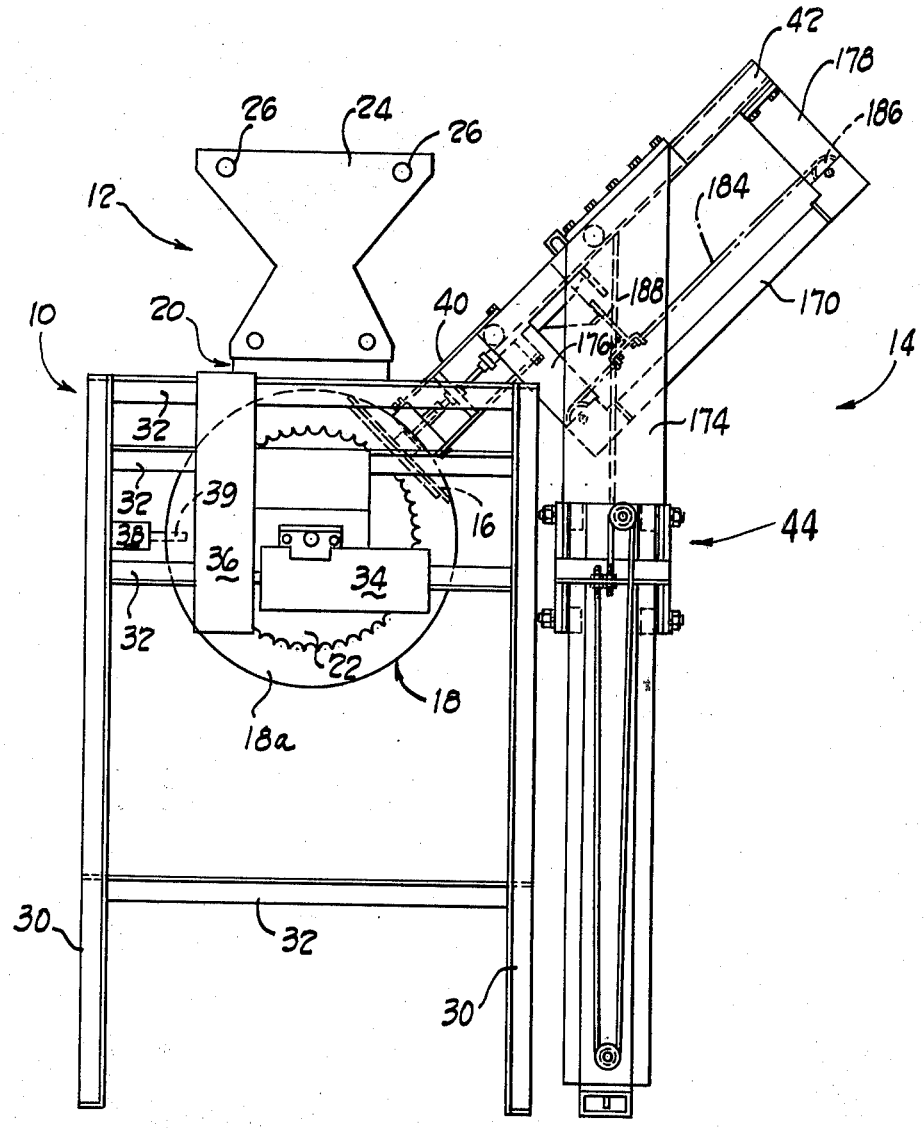
FIG. 1 is a side, elevational view of a barrel loading and unloading station constructed in accordance with a preferred embodiment of the invention.

FIG. 1 illustrates the overall construction of a barrel handling apparatus that, in the preferred embodiment, forms a plating barrel loading and unloading station. The apparatus comprises a support stand 10 that supports a plating barrel assembly 12 in a predetermined position with respect to an apparatus 14 for automatically releasing and preferably separating a barrel access door 16 from a plating barrel 18. As noted earlier, the support stand 10 is provided for those applications in which the barrel conveyor system (not shown) cannot serve as the means for supporting the barrel in alignment with the apparatus 14.

The barrel assembly 12 includes a conventional barrel cradle 20 (only a portion of which is shown) that rotatably supports the barrel 18, and a means for rotating the plating barrel including a gear 22 mounted to a circular end cap 18*a* of the plating barrel 18 which is coupled to a transmission (not shown) forming part of the plating barrel assembly 12. Those skilled in the art will recognize that the transmission is connected to a suitable driving source which imparts rotation to the plating barrel 18 whenever it is submerged in a plating tank. Hoist plates 24 are mounted to the top of the barrel assembly 12 and include pins 26 that are engageable by a hoist or other conveyer system used in transporting the barrel assembly 12 through the plating process.

The support stand 10 is fixed to the floor of the work area or other rigid mounting surface by suitable fasteners (not shown) and comprises a weldment formed from a plurality of vertically standing channels 30 spanned by lateral cross-members 32. A drive motor 34 and associated transmission 36 are mounted to one side of the support stand 10 and are coupled to the plating barrel 18 whenever the plating barrel assembly 12 is positioned on the support stand 10. Barrel positioning sensors such as switches (not shown) are mounted on the support stand and are actuated by structure forming part of the barrel 18, when the barrel is rotated to predetermined positions. Locking pins 38 (shown schematically), preferably pneumatically operated, extend into locking engagement with bores 39 formed in the end caps 18*a* of the plating barrel 18. When the plating barrel assembly 12 is placed on the support stand 10, the motor 34 is energized to rotate the barrel 18 until the access door 16 is located in predetermined alignment with the door releasing apparatus 14 (the position shown in FIG. 1). When the barrel reaches the aligned position, the pins 38 are actuated to engage and lock the position of the barrel.

The apparatus 14 for releasing and preferably removing the plating barrel access door 16 comprises a door handling assembly 40 that is supported for reciprocating movement towards and away from the barrel support stand, by a pair of angled trackways 42 (only one trackway is shown in FIG. 1). An elevating mechanism, indicated generally by the reference character 44 is operative to raise and lower the trackways 42 and hence the door handling assembly 40 with respect to the barrel support stand 10. The door handling assembly 40 is selectively movable to either an extended position at which it is engageable with the plating door 16 and a retracted position in which the assembly 40 is moved to an upper most position along the trackways 42, and spaced from the plating barrel 18.

Figure 2:
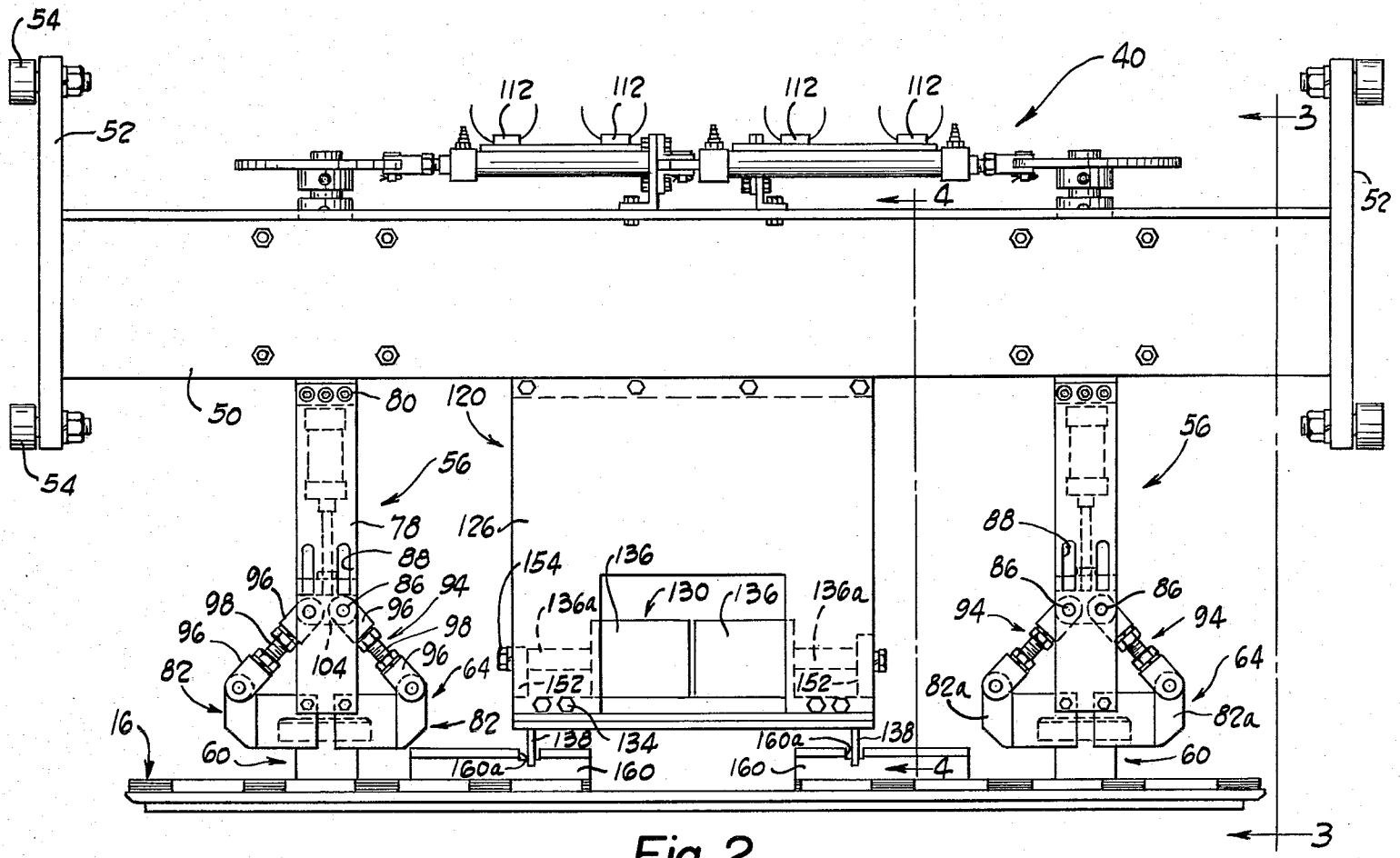
FIG. 2 is a front, elevational view of one embodiment of a door handling assembly constructed in accordance with a preferred embodiment of the invention.

FIG. 2 illustrates the overall construction of one embodiment of the door handling assembly 40. A rigid cross-piece 50, preferably T-shaped in cross-section serves as a primary support member and mounts the door engaging and releasing components. A pair of bearing arms 52 are welded to the ends of the cross-piece 50 in parallel alignment, each arm 52 rotatably mounting a pair of spaced rollers 54 which ride in the trackways 42.

Figure 3:
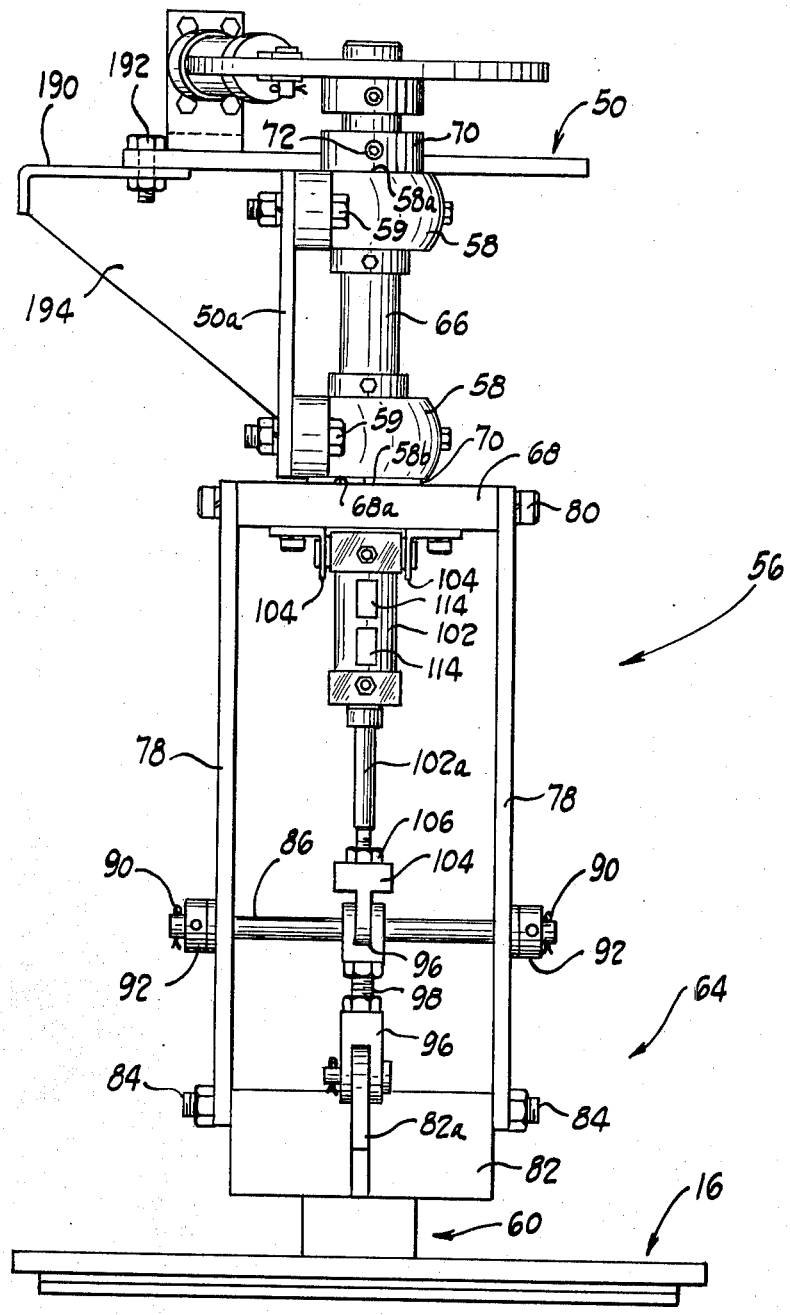
FIG. 3 is an end view of a rotatable spindle as seen from the plane 3—3 of FIG. 2.

A pair of door engaging spindles 56, rotatable between "lock" and unlock" are mounted at spaced locations along the cross-piece 50. Referring also to FIG. 3, each spindle 56 is rotatably supported by a pair of pillow blocks 58 that are suitably fastened by bolts 59 to a center leg portion 50*a* of the cross-piece 50. The spindles 56 are operative to engage and rotate locking structure, indicated generally by the reference character 60, forming part of the plating barrel access door 16. Each spindle 56 is rotated and counter rotated through a predetermined arc of rotation by a fluid pressure actuator 62 and each assembly includes a clamping arrangement 64 for gripping the access door locking structure 60.

In particular, a drive shaft 66 extends downwardly (as viewed in FIG. 3) through the pillow blocks 58 and is joined to a transverse drive plate 68. The axial clearance in the shaft 66 with respect to the pillow blocks 58 is controlled by a collar 70 that is fixed to the drive shaft 66 by a set screw 72 and which rides against a top radial surface 58*a* of the upper pillow block 50*a*. A thrust washer 71 provides a bearing surface between a lower radial surface 58*b* of the lower pillow block 50*a* and a top surface 68*a* of the drive plate 68.

The clamping arrangement 64 is supported between a pair of side plates 78 that are fastened to opposite side edges of the drive plate 68 by suitable threaded fasteners 80 and extend downwardly therefrom. The clamping arrangement 64 comprises a pair of clamp members 82 pivotally mounted between the lower ends of the side plates 78 by threaded fasteners 84. A pair of shafts 86 extend between the side plates 78 and ride in vertical slots 88 formed in the individual side plates. Cotter pins 90 and washers 92 loosely fix the axial position of the shafts 86 between the side plate 78 and allow unimpeded motion in the shafts along the slots 88. As seen best in FIG. 2, an adjustable actuating link 94 formed by a pair of clevises 96 joined by a threaded adjustment screw 98 extend between the shafts 86 and ears 82*a* welded to the individual clamp members 82. The disclosed linkage arrangement converts reciprocating, vertical motion in the shafts 86 into pivoting, clamping motion in the clamp members 82. A fluid pressure operated actuator 102 (available from Bimba Mfg. Co.) is mounted to the underside of the drive plate 68 by a pair of L-shaped brackets 104 and includes a piston rod 102*a* that threadedly engages a bracket 104 that coengages the shafts 86. A lock nut 106 locks the position of the piston rod 102*a* with respect to the bracket 104. Selective actuation of the actuator 102 raises or lowers the bracket 104, thus opening or closing the clamp members 82. Preferably, an elastomeric material is fastened to the inside arcuate surface of each clamp member 82 (not shown) to enhance the frictional engagement between the clamp members 82 and the door locking structure 60.

Figure 4:
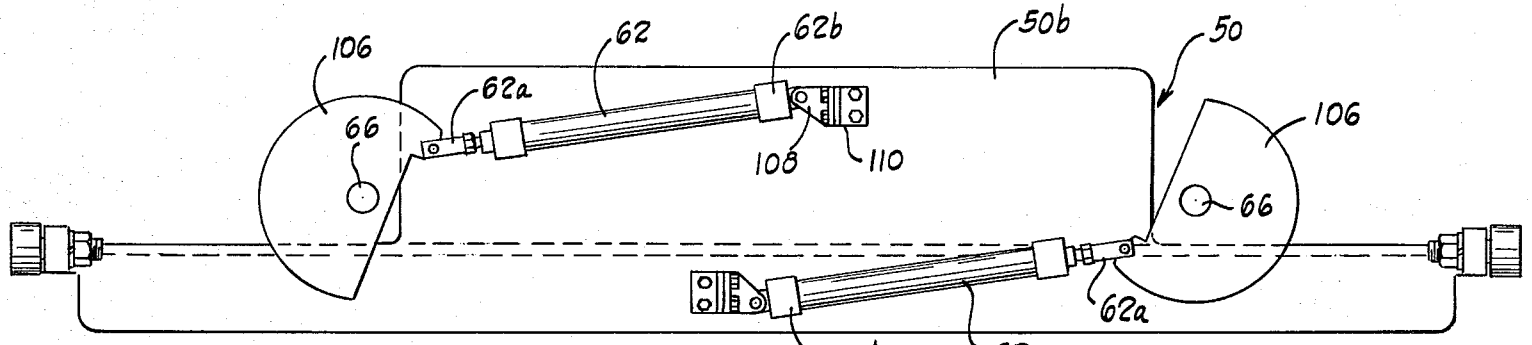
FIG. 4 is a top plan view of the door handling assembly illustrated in FIG. 2.

Referring also to FIG. 4, the rotation and counter-rotation in the spindles 56 are effected by the fluid pressure operated actuators 62, preferably comprising double acting pneumatic cylinders, available from Bimba Mfg. Co. A semi-circular disc 106 (shown best in FIG. 4) is fastened near the top end of each spindle drive shaft 66 and an extensible piston rod 62*a* forming part of the pneumatic cylinder 62 is pivotably connected to the disc, a spaced radial distance from the center of the shaft 66 and thereby defines a moment arm. The opposite end 62*b* of the pneumatic actuator 62 is pivotally connected to a clevis 108 that forms part of a mounting bracket 110 that is suitably bolted to a transverse plate section 50*b* of the cross-piece 50. As seen in FIG. 4, extension of the rod 62*a* produces counter-clockwise rotation in the drive shaft 66 whereas retraction of the actuator rod produces clock-wise rotation. Referring to FIG. 2, sensors 112, preferably forming part of the actuators 62 monitor the extension and retraction of the actuator rod 62*a* and are suitably interfaced to an electrical control system (not shown) which signals the operator or alternately shuts down the apparatus should a malfunction in the actuator 62 be detected. Similar sensors 114 are also attached to the clamp activators 102

Figure 5:
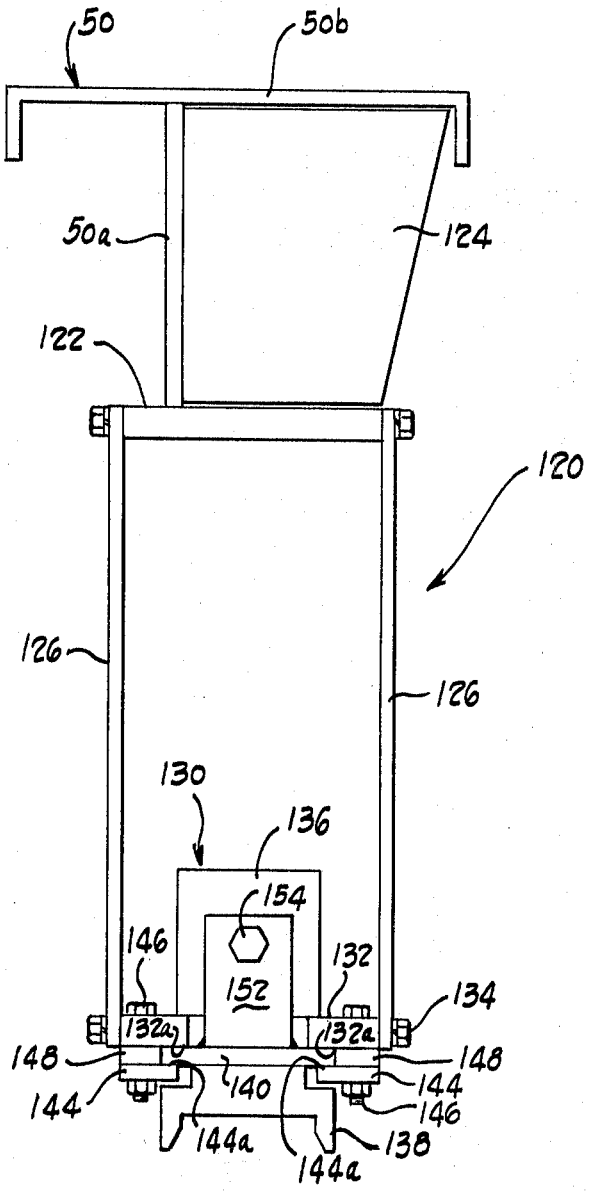
FIG. 5 is an end view of a slide mechanism as seen from the plane 4—4 of FIG. 2.

As shown best in FIG. 2, a plating door unlatching mechanism, indicated generally by the reference character 120, depends downwardly from the center of the cross-piece 50 intermediate the spindle assembly 56, and is operative to "latch" and "unlatch" the plating barrel door 16. Referring also to FIG. 5, a transverse mounting plate 122 is welded to the bottom edge surface of the center leg 50*a* of the cross-piece 50. A reinforcing gusset 124 is welded to the cross-piece 50 and the top surface of the mounting plate 122. Side support plates 126 are bolted to opposite side edges of the mounting plate 122 and extend downwardly therefrom and mount a slide mechanism, indicated generally by the reference character 130. A slide mechanism 130 comprises a transverse base plate 132 bolted to the inside, lower edges of the side support plates 126 by a plurality of fasteners 134 to which a pair of fluid pressure operated actuators 136, preferably double acting pneumatic cylinders available from Bimba Mfg. Co., are mounted. Each actuator 136 operates a slide mechanism that comprises a downwardly extending U-shaped member 138 welded to a slide plate 140 that is mounted for sliding movement in a transverse trackway defined between a bottom surface 132*a* of the mounting plate 132 and top surfaces 144*a* of a pair of relatively narrow plates 144 bolted to the underside of the mounting plate 132 by a plurality of fasteners 146. Spacers 148 placed intermediate the mounting plate 132 and the plates 144 define the width of the trackway and also laterally locate the slide plate 40. Each actuator 136 includes an extensible piston rod 136*a* that is connected to the side plate 140 by a bracket 152 which is fastened to the piston rod by a bolt 154 and is welded to the top surface of the slide plate 140.

As seen in FIG. 2, the U-shaped members 138 are engageable with actuating members 160 that form part of the access door 16 and which each include slots 160*a*. Energizing the actuators 136 causes the U-shaped members 138 to move laterally along the bottom of the base plate 132 and in the preferred embodiment, the pneumatic cylinders 136 are arranged and controlled so that they are coactuated to produce concurrent, opposed motion in the U-shaped members 138.

The door handling assembly 40, depicted in FIG. 2, is rollingly supported for motion towards and away from the barrel support stand by the trackways 42. In FIG. 1, the door handling assembly 40 is shown in its extended position at which it can engage and release the plating barrel access door 16. After releasing the door 16, the door handling assembly 40 is moved upwardly along the trackways to a retracted position, spaced from the plating barrel. The assembly 40 is driven between its retracted and extended positions by an actuator 170 (see FIG. 1) mounted between and parallel to the trackways 42.

Figure 6:
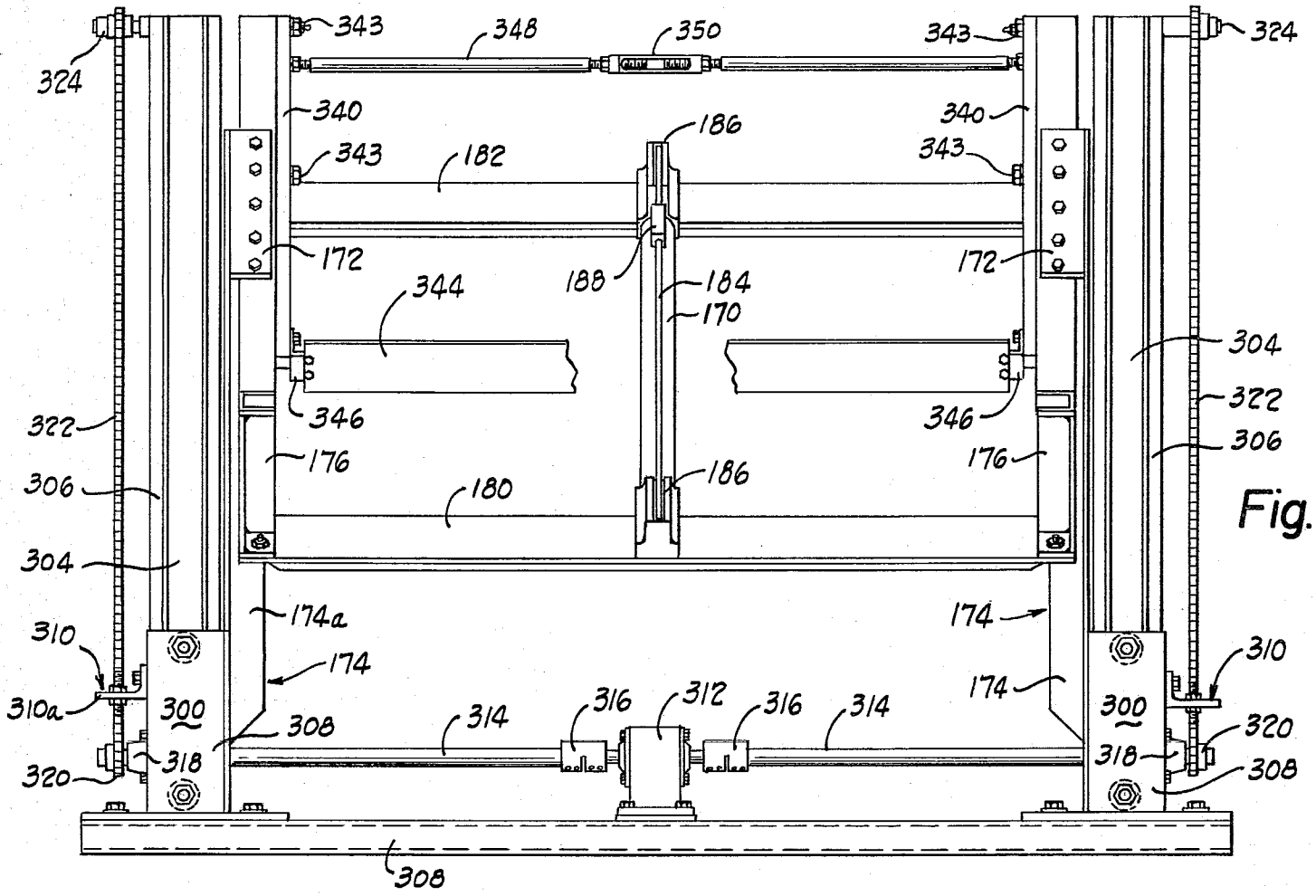
FIG. 6 is a front, elevational view, with portions broken away to show detail, of an elevator mechanism and associated support structure.

The trackways 42 define a path of motion oriented at approximately 45° from the vertical and as seen best in FIG. 6, are each fastened to the underside of a flange 172 formed at the top of vertically extending elevator arms 174 forming part of the elevator mechanism 44 (see FIG. 1). Relatively short, parallel support members 176, 178 extend downwardly from the lower and upper ends of the trackways, respectively (the members 178 are shown in FIG. 1). The lower support members 176 are fastened to the inside surface of the elevator arms 174 and thus rigidly locate the lower ends of the trackways 42. As illustrated in FIG. 6, upper and lower cross members 180, 182 extend between the lower ends of the support members 176, 178 respectively. The trackways 42 and the frame members 176, 178, 180, 182 together form a rigid box-like frame structure that supports precise movement in the door handling assembly 40 and serves as a rigid mounting for the door assembly actuator 170.

As illustrated in FIG. 6, the actuator 170 is centrally mounted to the cross-members, 180, 182 and in the preferred embodiment is a cable actuator available from Tol-O-Matic that comprises a pneumatic cylinder that drives a cable 184 between a pair of pulleys 186 mounted at either end of the actuator 170 and forming a part thereof. A drive bracket 188 is reciprocally driven between the pulleys 186 by selective actuation of the cable actuator 170. The drive bracket 188 is connected to the door handling assembly 40 through a connecting bracket 190 (shown best in FIG. 3) which is fastened to the cross-piece 50 by bolts 192 and includes a reinforcing gusset 194. Motion in the drive bracket 188 produces attendant, parallel motion in the door handling assembly 40.

When the door handling assembly 40 is driven to its extended position (as shown in FIG. 1) it is operative to release and remove the barrel access door 16 from the plating barrel 18. Although the assembly 40 can be suitably modified to release and separate a variety of access doors such as the door disclosed in U.S. Pat. No. 3,507,529 (all such modifications being contemplated by the present invention), the assembly 40 disclosed in FIG. 2 is particularly adapted to release and remove an improved barrel access door that forms part of the present invention.

Figure 7:
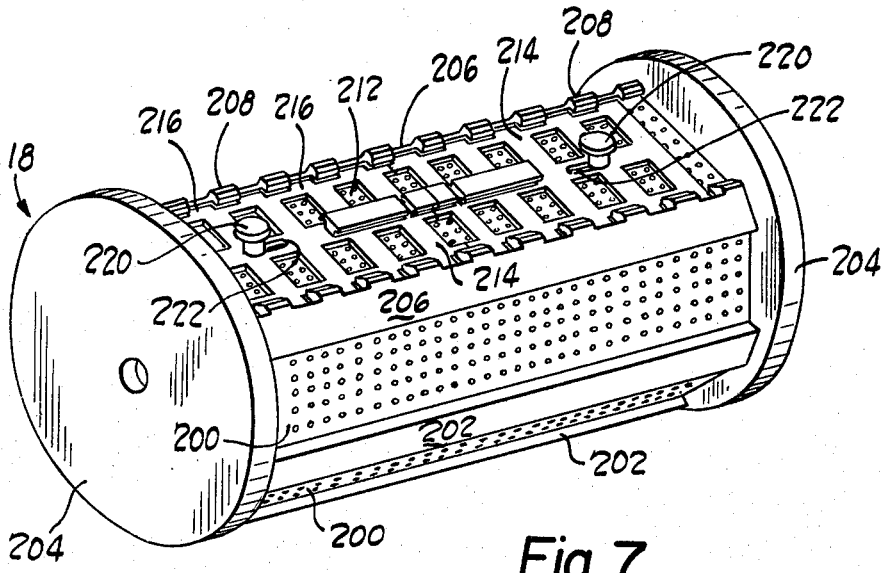
FIG. 7 is a perspective view of a metal finishing barrel that includes one embodiment of an improved barrel access door.
Figure 8:
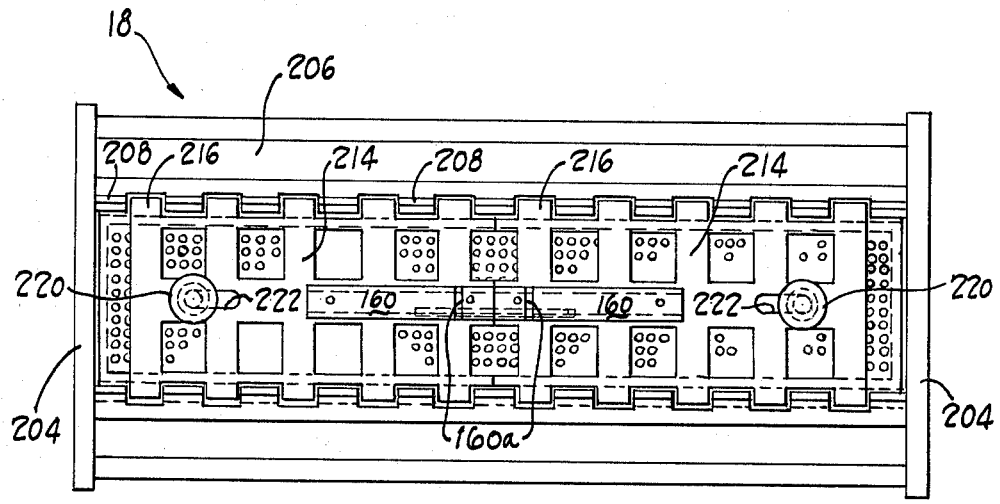
FIG. 8 is a top plan view of the barrel shown in FIG. 7.
Figure 9:
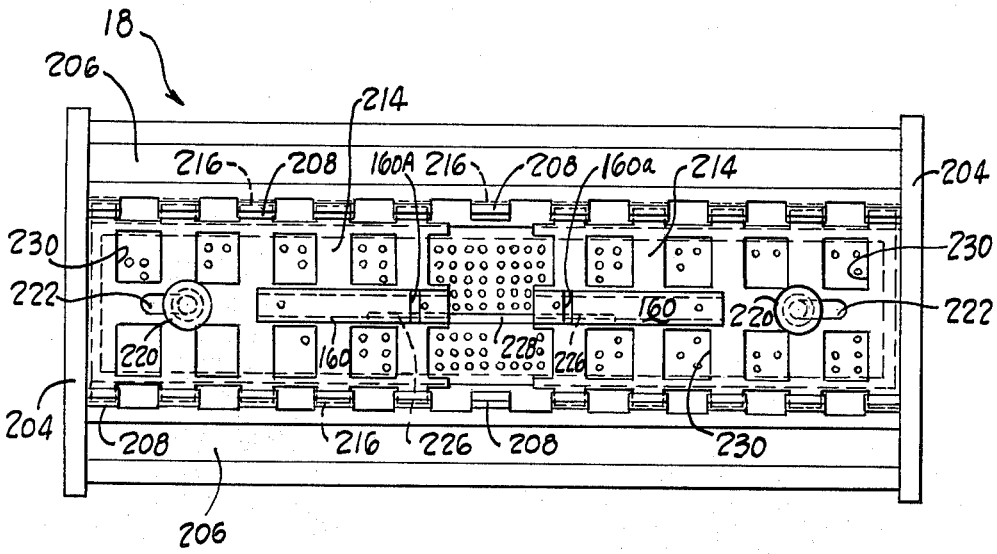
FIG. 9 is a top plan view of the barrel shown in FIG. 7 with certain members shifted to show a locked position of the access door.

The improved access door 16 enhances the overall operation and reliability of the door handling assembly 40 and is illustrated in FIGS. 7–9. The construction of the metal finishing barrel 18 is conventional and as seen in FIG. 7, includes a plurality of apertured sidewalls 200 contiguously joined by ribs 202 that are arranged to form a cylindrical-like body, hexagonal in cross-section that extends between a pair of circular end caps 204. A barrel access opening is defined between a pair of longitudinal ribs 206 that include locking structure in the form of a plurality of locking lips 208 spaced longitudinally along the ribs 206 to form locking edges along either side of the access opening. Referring also to FIGS. 8 and 9, the improved access door 16 includes a perforate sheet 212 that spans the access opening and serves as the closure panel. When positioned on the barrel the closure panel 212 rests atop stepped surfaces formed on the ribs 206 located below the locking lips 208. The transverse dimension of the panel 212 is slightly less than the distance between opposed locking lips 208 to enable the panel to pass between the locking lips.

A pair of slidable members 214 forming latch plates are mounted on top of a closure panel 212 and are engageable by the locking lips 208. Opposite, outer edges of each latch plate 214 are interrupted to form a plurality of spaced tongues 216 sized to fit between the locking lips on the plating barrel. When the door 16 is placed in the barrel access opening, the latch plates 214 are moved laterally across the closure panel so that the locking tongues travel under the locking lips 208 thus interlocking the door 16 to the plating barrel 18. A locking knob 220 (forming the locking structure 60 in FIGS. 2 and 3) associated with each latch plate 214 extends through a slot 222 formed in each latch plate and threadedly engages the closure panel 212. In the preferred embodiment, clockwise rotation of the locking knob fixes the latch plates 214 relative to the closure panel 21 and prevents lateral movement, whereas counterclockwise rotation of the knobs 220 releases the latch plates.

Each latch plate 214 is guided for movement in the longitudinal direction (with respect to the closure panel 212) by the slots 222, which also determine the limits of movement for the latch plates, and a slot 226 formed on the underside of each latch plate that engages a raised track 228 cemented to the top of the closure panel 212. The slots and associated engagements prevent skewing of the latch plates 214. Each latch plate 214 includes a plurality of circulation openings 230 to allow plating solution to be admitted or discharged through the perforate closure panel 212. The latch plate actuating members 160, referenced earlier, are cemented to a central rib on each latch plate. The slots 160*a* formed in each actuating member are engageable by the U-shaped slide member 138 (shown in FIG. 5) so that the sliding, lateral motion in the slide mechanism 130 forming part of the door handling assembly 40 causes attendant sliding motion in the latch plates 214. As described earlier, the slide mechanism actuators 136 are coactuated to produce concurrent opposed motion in the slide members 138. The latch plates 214 and associated slots 222 are configured so that opposed, outward movement in the latch plates causes interlocking engagement between the tongues 216 and the locking lips 208 as seen in FIG. 9 whereas movement in the latch plates towards each other, disengages the latch plates 214 from the locking lips 208 as seen in FIG. 8.

In order to mount the barrel access door 16 to the plating barrel, the latch plates 214 are slid towards each other to the position shown in FIG. 8 so that the tongues 216 of the latch plates 214 will be aligned with the spaces between the locking lips 208 spaced along the ribs 206. The access door 16 is then placed into the barrel opening and the latch plates 214 are then moved outwardly so that the tongues 216 move to their interlocking position below the locking lips 208 (as seen in FIG. 9) thus securing the closure panel 212 in the opening. The locking knobs 220 are then rotated clockwise to clamp the latch plates 214 to the closure panel 212 thus locking their position. Removal of the access door 16 is accomplished by reversing the steps described above.

The disclosed door handling assembly 40 is operative to manipulate the locking and latching members of the access door 16 to effect automatic release and removal of the access door 16 from the plating barrel 18. In the preferred mode of operation, the plating barrel assembly 12 is first lowered onto the barrel support stand 10 (see FIG. 1) by a suitable conveyor or hoist system (not shown). The barrel drive motor 34 is energized to rotate the plating barrel so that the access door 16 is in alignment with the door handling apparatus 14.

Figure 10:
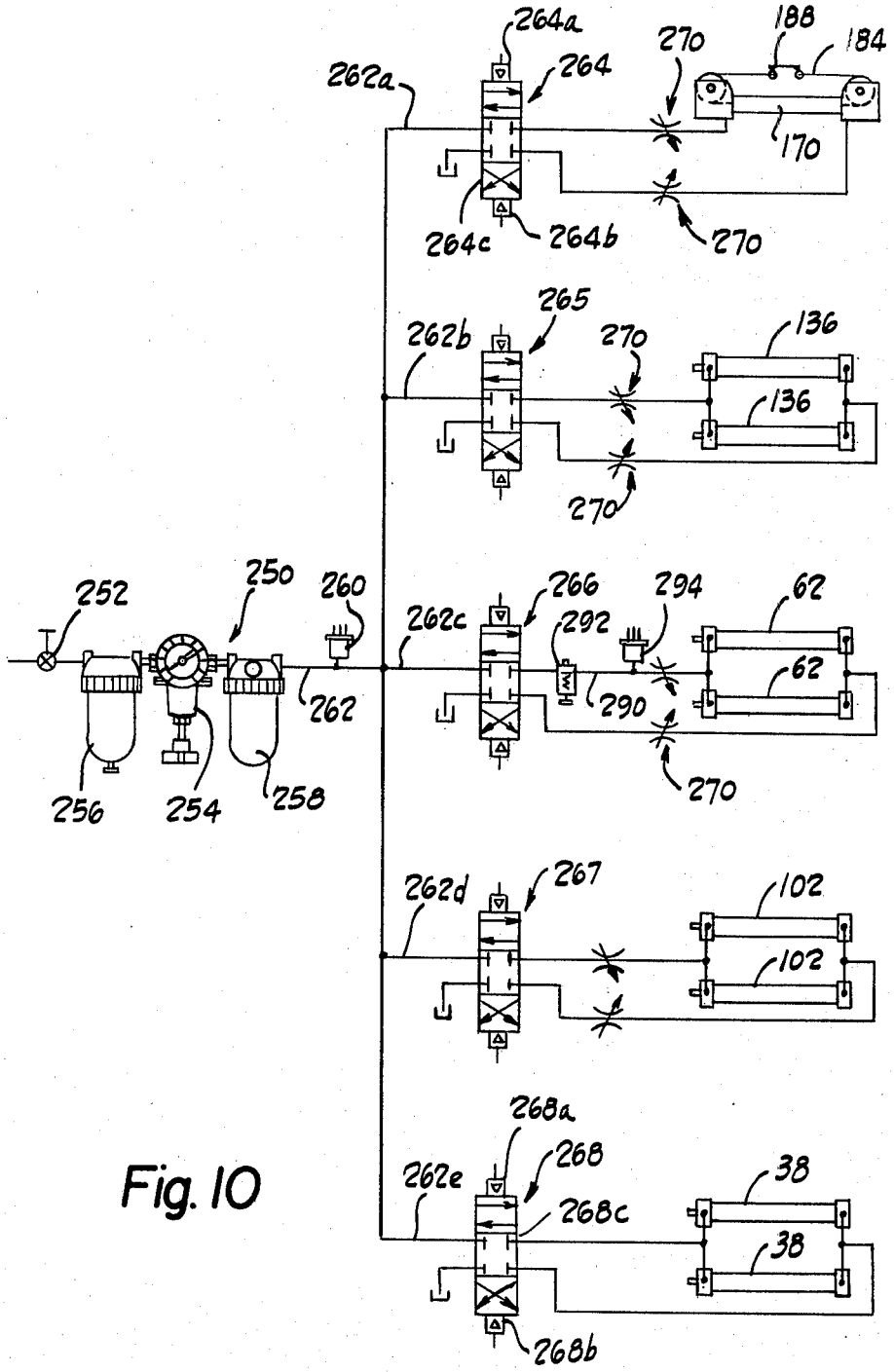
FIG. 10 is a schematic of a fluid pressure actuating system for operating the barrel loading and unloading station.

Once the plating barrel 18 has been rotated to the aligned position, a fluid pressure actuating system shown in FIG. 10 under the control of an electrical control system (not shown) operates the door handling apparatus. In the preferred embodiment, the various described fluid pressure actuators are pneumatically operated. As seen in FIG. 10, the pneumatic circuit is connected to a source of air pressure 250 that includes a hand valve 252, a line regulator 254, a moisture trap 256 and an oiler 258. A pressure switch 260 monitors pressure in a supply line 262 and signals if excessive pressure is encountered. The supply line 262 communicates with the actuators through branch lines 262*a–e*. Dual solenoid operated air valves 264–268 associated with each of the branch supply lines 262*a–e*, respectively, control the communication of air pressure to the various actuators that form part of the door handling apparatus.

The solenoid operated valves 264–268 are substantially identical in construction and are available from I.S.I. Fluid Power Inc. The solenoids, for example 264*a*, 264*b* are selectively energized to shift the position of the valve element 264*c*. When the solenoids are deenergized, the valve elements assume the position shown in FIG. 10 and block all communication between the branch conduits and the associated actuators.

In particular, the valve 264 controls the communication of air pressure to the chassis cable actuator 170. When the valve element 264*c* is driven downwardly (as viewed in FIG. 10), air pressure is communicated to the left end of the cylinder 170 and the cable is driven to the left. When the valve element 264*c* is driven upwardly, air pressure is communicated to the right end of the cylinder and the cable is driven towards the right. Flow restrictors 270 control the flow rate of pressure into the cylinders and thus determine the actuation rate of the actuator. The solenoid valve 265 controls the communication of air pressure to the slide actuators 136. Similarly, the valves 266 and 267 control the communication of air pressure to the spindle actuators 62 and the clamp actuators 102. The solenoid valve 268 controls the actuation of the locking pins 38 which are mounted on the barrel support stand. When the upper solenoid 268*a* is energized, the valve element 268*c* is driven downwardly and the locking pins retract; energizing the lower solenoid 268*b* drives the valve element 268*c* upwardly and extends the locking pins.

Returning now to FIG. 1, the barrel positioning sensors (not shown) energize the lower solenoid 268*b* of the control valve 268 thereby extending the pins 38 thus locking the plating barrel 18 in the aligned position shown. Prior to the commencement of the door releasing operation, the valve 265 is energized to communicate pressure to the head end of the slide mechanism actuator 136 to drive the U-shaped members 138 to their outer positions. The control valve 264 is energized to communicate air pressure to the head end of the spindle cylinders 62 so that the spindles are rotated to their "locked" position. The control valve 267 is energized to communicate air pressure to the rod end of the clamp 102 thereby opening the clamp members 82.

The door releasing sequence is then initiated. The control valve 264 is energized to communicate air pressure to the left end of the cable cylinder 170 (as viewed in FIGS. 1 and 10) thereby driving the cable 184 and attached door handling assembly 40 downwardly to the door engaging position shown in FIG. 1. In this position, the opened clamp members 82 surround the barrel door locking knobs 220 and the U-shaped slide members 138 engage the slots 160*a* formed in the latch plate actuating members 160.

The control valve 267 is then energized to communicate air pressure to the rod end of the clamp cylinders 102, closing the clamp members 82 around the locking knobs 220. The control valve 265 is energized to communicate air pressure to rod end of the spindle actuators 62 thus retracting the piston rods 62*a* and rotating the spindles 56 and locking knobs 220 in the counterclockwise direction thus releasing the latch plates 214. The control valve 265 is energized to communicate air pressure to the rod ends of the slide actuators 136 thus sliding the latch plates 214 towards each other, thereby releasing the access door 16 from the plating barrel 18. The spindle actuators 62 are then reverse actuated to rotate the locking knobs 220 in the clockwise rotation thus fixing the position of the latch plates 214 in the unlatched position. The cable cylinder 170 is energized to raise the door handling assembly 40 while maintaining the engagement between the clamp members 82 and the locking knobs 220 so that the access door 16 is carried with the door assembly 40. Replacing and resecuring the access door 16 is accomplished by reversing the sequence described above.

According to a feature of the invention, the torque applied by the spindle 56 is limited to prevent overstressing the door locking knobs 220. Referring to FIG. 10, an air supply line 290 that extends between the control valve 266 and the rod ends of the spindle actuators 62 includes a pressure regulator 292 and a pressure sense switch 294. As discussed earlier, retraction of the actuator rod 62*a* produces a clockwise or "locking" rotation in the spindles 56. The pressure regulator 292 is adjusted to limit the maximum pressure that can be communicated to the rod end of the actuator 62 and thus limits the maximum torque that the actuator 62 can apply to the drive disks 106. The pressure switch 294 in connection with the electrical control system (not shown) deenergizes the control valve 266 if the line regulator 292 malfunctions and communicates excessive pressure to the actuators 62. This feature prevents the access door locking knobs 220 from being overstressed or damaged by "over-rotation".

After the access door 16 has been removed from the plating barrel, the plating barrel 18 can be unloaded manually by an operator or alternately, the barrel can be rotated to dump its contents into an awaiting receptacle located below the barrel. In employing the alternate method for unloading, the locking pins 38 are retracted and the drive motor 34 is energized to rotate the barrel for one or more revolutions. At the conclusion of the unloading step, the plating barrel 16 is either rotated to its aligned position with the door handling apparatus or alternately rotated to a predetermined loading position and locked.

Figure 11:
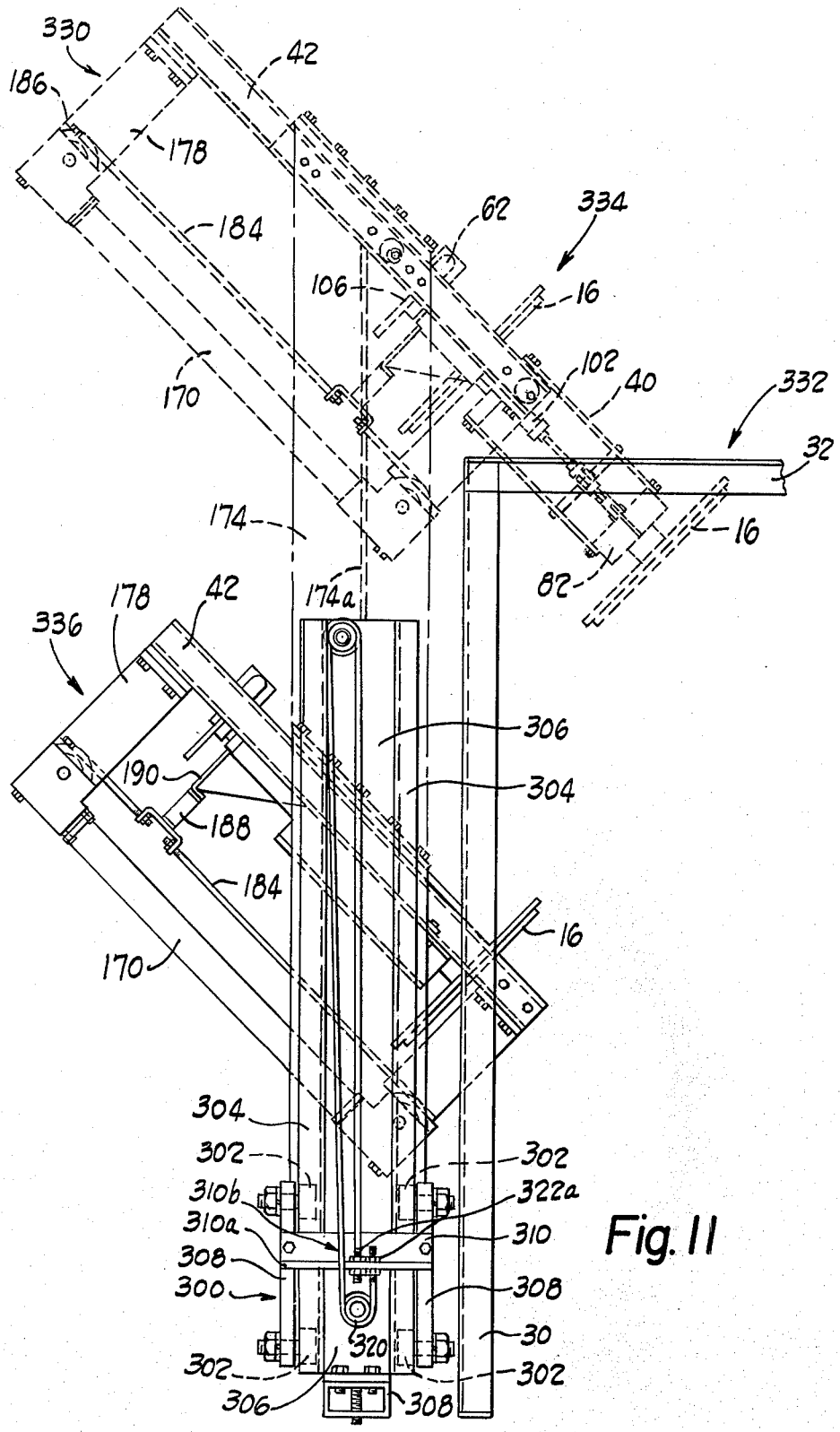
FIG. 11 is a side elevational view of the door handling apparatus shown in a plurality of positions.

In the preferred embodiment, the trackways 42 and door handling assembly 40 are lowered by the elevator mechanism 44 after the access door 16 has been removed from the plating barrel 18. This features expands the access to the plating barrel 18 and facilitates the unloading and loading of the barrel. The construction of the elevator 44 for raising and lowering the trackways 42 and associated door handling assembly 40 is shown in FIGS. 6 and 11. The elevator arms 174 which mount the trackways 42 and associated frame structure each include a vertical rigidizing rib 174*a* welded to the inside surface of the elevator arms. Each arm is suitably attached, as by welding, to a carriage assembly 300 that includes four rollers 302 arranged in pairs which ride in tracks formed by a pair of vertically oriented U-channels 304 fastened to opposite sides of a vertically standing box channel 306 that forms a supporting upright for the door handling apparatus 14. The uprights 306 are spaced apart and bolted to a transverse box channel 308 that is suitably fastened to the floor of the work area. Alternately, the uprights 306 can be fitted to a wheel assembly (not shown) for providing mobility to the door handling apparatus 14, allowing it to be used at a plurality of locations within the work area. The rollers 302 that form a pair are fastened to opposite ends of a rigid arm 308. An L-shaped, transverse bracket 310 joins the two arms 308 that form the carriage assembly 300.

Referring in particular to FIG. 6, the carriage assemblies 300 are concurrently raised and lowered by a chain drive system. A gear box 312 coupled to a power source such as an electric motor (not shown) is mounted centrally on the base channel 308. The gear box 312 drivingly engages a pair of transversely extending drive shafts 314 through couplings 316. The drive shafts 314 extend through bearing assemblies 318 attached to the uprights and mount drive sprockets 320 at the extreme outer ends. Drive chains 322 associated with each carriage assembly 300 are reeved around the respective drive sprockets 320 and idler sprockets 324 suitably mounted near the top of the uprights 306. The ends 322*a* (shown in FIG. 11) are fastened to a horizontal leg 310*a* of the transverse bracket 310 by threaded fasteners 326. A notch is cut into the horizontal leg 310*a* at the position indicated by the reference character 310*b* to provide clearance for the drive chain 322. Suitably height-sensing devices (not shown) control the vertical position of the elevator 44.

The lowered and raised vertical positions of the elevator 44 are both illustrated in FIG. 11 as well as the retracted and extended positions of the door assembly 40. The upper position (shown in phantom indicated by the reference character 330 illustrates the operative position of the trackways 42 and door assembly 40. In general, when the trackways 42 are raised to the operative position, the door assembly 40 is movable from the extended position, indicated by the reference character 332 to the retracted position indicated by the reference character 334. In general the trackways 42 and the associated framework (elements 178, 176, 180, 182, etc.) are lowered to the position indicated by the reference character 336 only when the door assembly 40 is in its retracted position.

The elevating feature of the present invention provides added flexibility to the door handling apparatus and increases the accessibility to the opened plating barrel. The ability to raise and lower the door handling assembly 40 provides yet another advantage of the invention. In certain plating applications, the plating barrel assembly 12 includes a pair of barrels arranged in a stacked relationship. The present apparatus can be easily adapted to remove and replace the access doors on both barrels of a barrel assembly constructed in this fashion. In this application, the elevator 44 would raise and lower the trackways 42 between two operative positions. In one position, the door assembly 40 is aligned with the upper plating barrel and is sequenced to remove and replace the access door to enable the upper barrel to be unloaded and loaded. After loading the one barrel the elevator 44 moves the trackways 42 to a second operative position at which the door assembly 40 is aligned with the second plating barrel. The assembly 40 is then sequenced to remove and replace the access door of the second barrel. In this way, a single door handling assembly 40 can accommodate the plating barrel assembly having a plurality of plating barrels.

Figure 13:
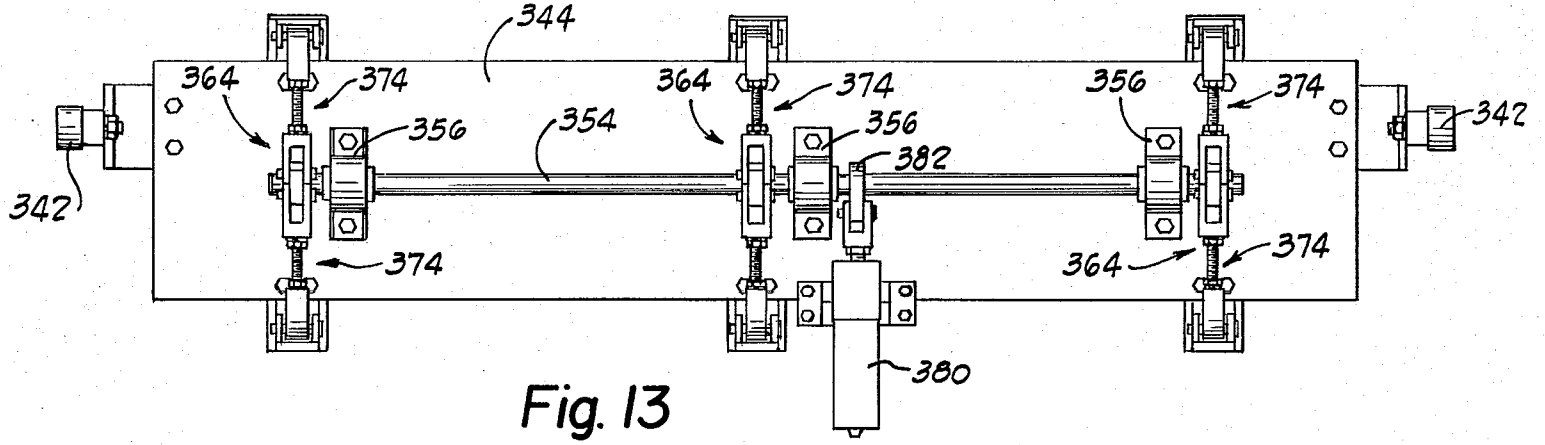
FIG. 13 is a top plan view of the door handling assembly shown in FIG. 12.
Figure 12:
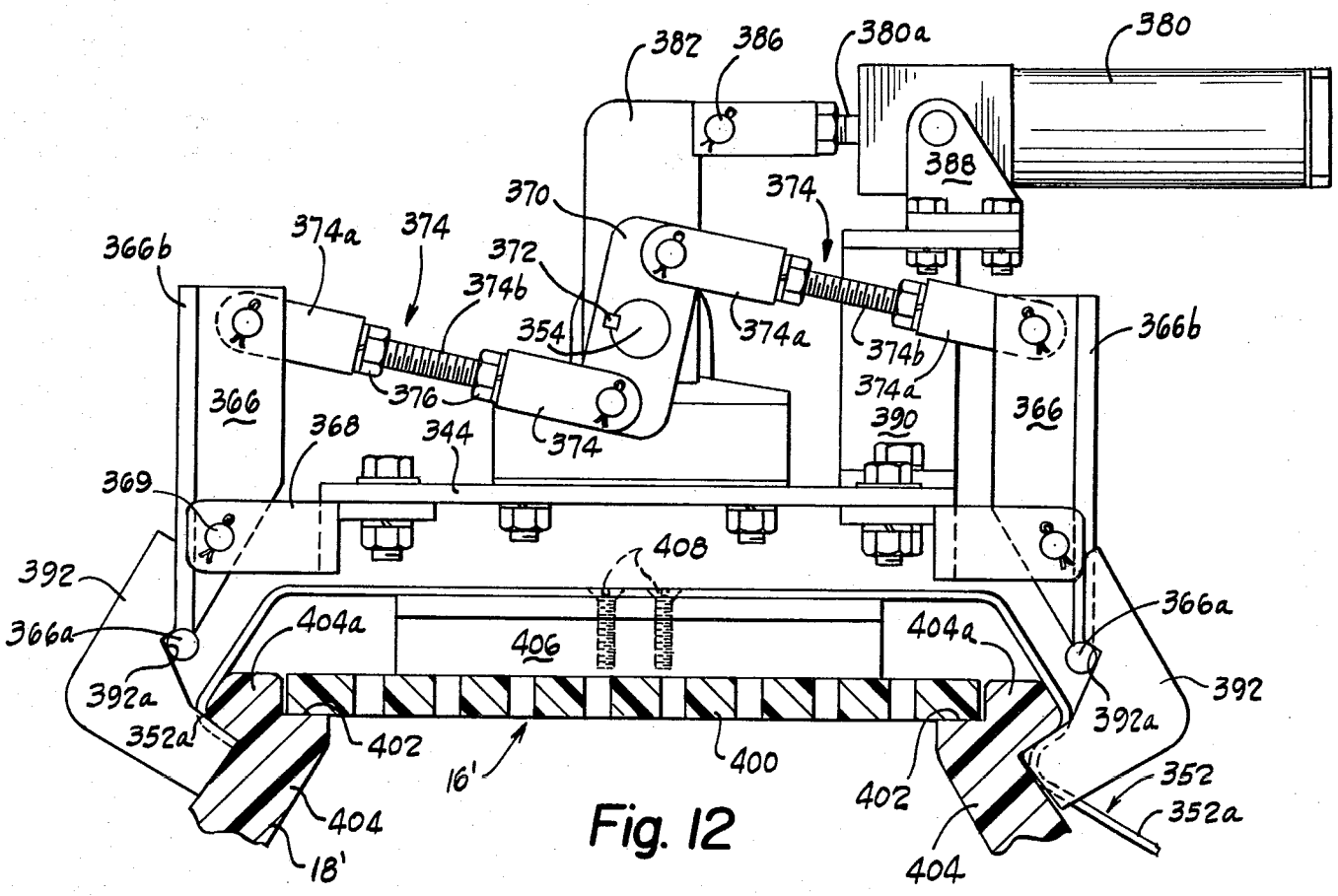
FIG. 12 is an end view of another embodiment of a door handling assembly.

FIGS. 12 and 13 illustrate an alternate door handling assembly 40' for releasing a barrel access door 16' that is secured to a plating barrel 18' by resilient clamps. A portion of the assembly is also shown in FIG. 6. The assembly 40' rides in the trackways 42 in the same manner as the door assembly 40 and is driven between extended and retracted positions by the cable cylinder 170.

The door handling assembly 40' includes a pair of arms 340 (shown in FIG. 6) that each mount a pair of spaced rollers 342 (only one roller of each pair of shown in FIG. 13) that roll in the trackways 42. The rollers 342 are attached to the arms 340 by threaded fasteners 343 (see FIG. 6). A mounting plate 344 extends between and is fastened to the lower ends of the roller arms 340 by L-shaped brackets 346. A spreader bar 348 including a turn buckle 350 extends between the upper ends of the bearing support arms 340 (to maintain parallelism).

Referring in particular to FIGS. 12 and 13, the mounting plate 344 supports a mechanism that engages and releases door securing clamps 352 from the plating barrel 18'. The clamp releasing mechanism includes a longitudinal drive shaft 354 that is rotatably supported by spaced pillow blocks bolted at spaced intervals along the base plate 344. A plurality of clamp spreaders indicated generally by the reference character 364 are operatively connected to the drive shaft 354 at spaced location, the number of spreaders 364 corresponding to the number of securing clamps used on the plating barrel. Each clamp spreader includes a linkage arrangement that operates a pair of spreader arms 366, each arm 366 being pivotally attached to a U-shaped bracket 368 by a pivot pin 369. The brackets 368 are bolted along the edge of the base plate 344 at spaced locations. The linkage arrangement, comprises a driving link 370 keyed to the drive shaft 360 by a keyway 372 and a pair of connecting links 374 extending between the driving link 370 and the individual spreader arms 366. Each connecting link 374 comprises a pair of clevises 374*a* joined by an adjustable threaded section 374*b*. Lock nuts 376 lock the position of the clevises. As viewed in FIG. 12, counterclockwise rotation of the drive shaft 354 through a predetermined arc will cause the lower extremes of the spreader arms 366 to move outwardly. Clockwise rotation of the drive shaft 354 moves the lower ends inwardly.

The drive shaft 354 is rotated through a predetermined arc by a fluid pressure operated actuator 380, preferably a pneumatic cylinder, that is operatively connected to the drive shaft 354 by an actuating link 382. The link 382 is connected to an actuating rod 380*a* of the actuator 380 by a clevis 384 and pin 386. The actuator 380 is pivotally held by brackets 388 which are bolted to a raised bracket 390 that in turn is bolted to the base plate 344. Reciprocation of the piston rod 380*a* thus produces concurrent pivotal motion in the spreader arms 366 towards and away from each other.

In accordance with this embodiment of the invention, the resilient clamps 352 which secure the access door 16' to the plating barrel 18' include structure engageable by the spreader arms 366. The structure comprises a pair of clips 392 (only one clip of a pair is shown in FIG. 12) welded on each end of the clamp 352 and extend upwardly therefrom. The clips are welded to side edges 352*a*. Each clip 392 includes a notched portion 392*a* that is engageable by a cylindrical portion 366*a* formed at the extreme bottom of each spreader arm 366. The cylindrical portion 366*a* is preferably formed by a rod welded to the bottom edge of the arm 366, the ends of which extend beyond the side edges 366*b* of the arm. The width of the arms 366 is less than the distance between each pair of clips 392. The axial length of the rods 366*a* is greater than the spacing thus the ends of the rod 366*a* engage the notched portion 392*a* as the arms 366 pass between the clips 392. As seen in FIG. 12, outward, pivotal motion in the lower half of the spreader arms 366 (produced by counterclockwise rotation in the drive shaft 360) moves the clips 392 outwardly and expands the clamp 352 thereby releasing the clamp 352 from the barrel 18'.

The present invention provides another embodiment of an improved barrel access door 16'. As illustrated in FIG. 12, the door 16' comprises a perforate sheet 400 that serves as a closure panel for the barrel access opening. When mounted to the barrel, the panel 400 fits into a recessed step 402 formed in adjacent longitudinal ribs 404. The ribs 404 each define a longitudinal, curved, projecting surface 404*a* that is engageable by the ends of the clamps 352. According to the invention, the door clamps 352 are fastened to and form part of the access door 16'. A spacing block 406 is attached to the top surface of the closure panel 400 at spaced locations along the longitudinal extent of the panel. The resilient clamps 352 are fastened to the blocks 406 by suitable fasteners 408.

In the preferred barrel access door 16', as distinguished from the prior art, the door securing clamps 352 form part of the door. This door construction, enables the door handling assembly 40' to separate the access door from the plating barrel 18' by maintaining the engagement between the spreader arms 366 and the clips 392 while being driven to the retracted position along the trackways 42 by the cable cylinder 170. The access door 16' is replaced and resecured by reversing the cable cylinder 170 to drive the door assembly to its extended position thereby placing the access door in the barrel access opening and then energizing the actuator 380 to rotate the drive shaft 354 in the clockwise rotation so that the spreader arms 366 pivot inwardly allowing the clamp 352 to reengage the barrel ribs 404.

Figure 14:
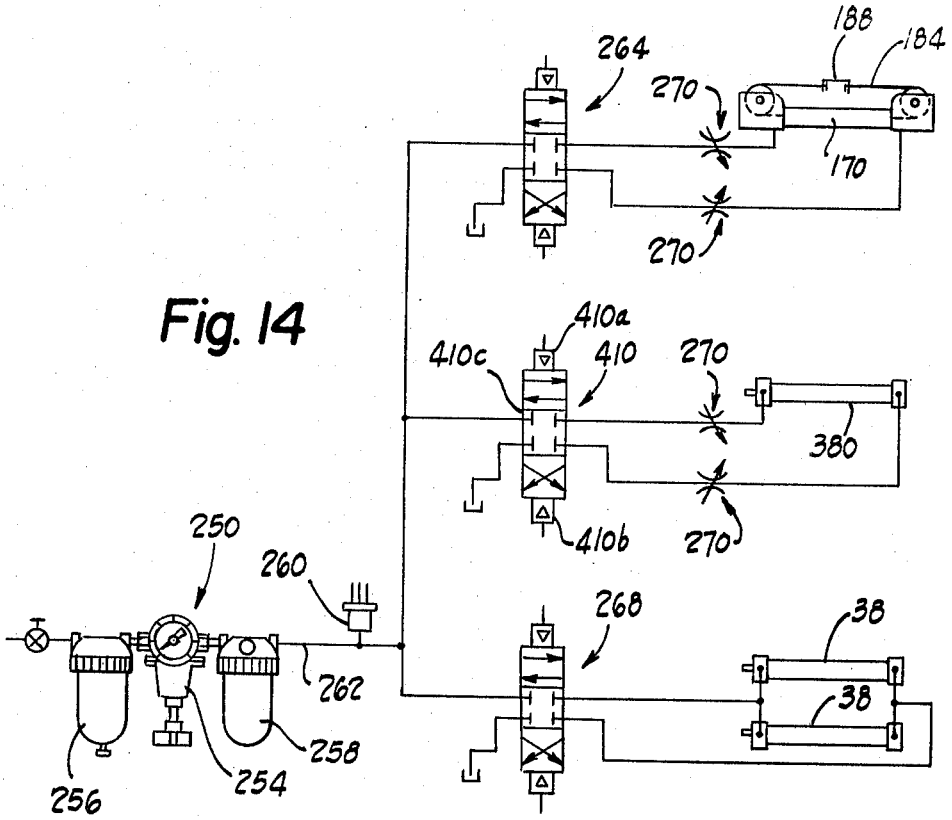
FIG. 14 is a schematic of a fluid pressure actuating system for operating the door handling assembly shown in FIG. 12.

FIG. 14 illustrates the fluid pressure actuating circuit for the door handling assembly 40'. The pneumatic circuit includes the source of pressure 250, the solenoid control valves 264, 268 for controlling the communication of air pressure to the cable cylinder 170 and the locking pins 38. These elements of the circuit operate in the manner described earlier in connection with the door handling assembly 40 and it does not require further explanation. The circuit for controlling the clamp arm actuator 380 comprises a solenoid operated control valve 410 that is substantially identical to the control valves 264–268 described earlier. The valve 410 controls the communication of air pressure from the line 262 to the rod and head ends of the actuator 380. When the upper solenoid 410*a* is energized, the valve element 410*c* is driven downwardly and air pressure is communicated to the rod end of the actuator 380 and as viewed in FIG. 12, the arms 366 pivot inwardly and release the clamp 352. When the lower solenoid 410*b* is energized the valve member 410*c* is driven upwardly and air pressure is communicated to the head end of the actuator 380, effecting extension of the piston rod 380*a* and pivoting the arms 366 outwardly to engage the clips 392 thus releasing the clamp 352 from the barrel 18'. The adjustable flow restrictors 270 control the actuation rate of the actuator 380. As described earlier, the control valves 264, 410, and 268 are sequenced by an electrical control system (not shown).

Although the present invention has been described with a certain degree of particularity, it is understood that various changes can be made to it without departing from the spirit or scope of the invention as described and hereinafter claimed.

I claim:

1. A door handling apparatus for removing an access door from a metal finishing barrel or the like, comprising:

(a) means for supporting a barrel in a predetermined aligned position with a portion of said door handling apparatus;

(b) an assembly supported for reciprocating motion towards and away from said barrel supporting means;

(c) means for driving said assembly between a first position wherein said assembly is located adjacent to said barrel and a second position, spaced from said first position;

(d) a pair of rotatable spindles, carried by said assembly engageable with locking structure on a barrel access door, said spindles rotatable between locked and unlocked positions;

(e) a latching mechanism carried by said assembly and engageable with an actuating member forming part of a barrel latching means and operative to move said latching means between latched and unlatched positions;

(f) said assembly including means for maintaining engagement between said assembly and said access door to effect separation of said door from said barrel as said assembly moves to its second position.

2. A door handling apparatus for removing an access door from a metal finishing barrel or the like, comprising:

(a) barrel supporting means for supporting a barrel in predetermined alignment with a portion of said door handling apparatus;

(b) an assembly supported for reciprocating motion towards and away from said barrel supporting means;

(c) means for driving said assembly between a first position wherein said assembly is located adjacent to a barrel supported by said barrel supporting means and a second position, spaced from said first position;

(d) spreader means carried by said door assembly engageable with structure forming part of a door clamping means carried by said access door;

(e) said spreader means including means for spreading and releasing said clamping means from said barrel, said spreader means including means for maintaining engagement between said assembly and said access door to effect separation of said door from said barrel as said assembly is moved to its second position.

3. The apparatus of claims 1 or 2 further comprising elevating means for raising and lowering said assembly.

4. A loading and unloading station for a plating barrel or the like having a removable access door, comprising:

(a) barrel supporting means for supporting a plating barrel in a predetermined location, said means including means for positioning said plating barrel in an aligned relationship with a door handling apparatus;

(b) said door handling apparatus including an assembly mounted for reciprocating motion along a first path towards and away from said barrel supporting means;

(c) drive means for driving said assembly between a first position, wherein said assembly is located adjacent said barrel supporting means and a second position spaced from said first position;

(d) door releasing means carried by said assembly and actuatable to release a door retaining means on said plating barrel, said door releasing means comprising at least one rotatable spindle including a clamping arrangement at one end, engageable with locking structure on said barrel door and operative to rotate said structure between locked and unlocked positions; and (e) door holding means carried by said assembly operable to grip said plating door when said assembly is in its first position thereby effecting separation of said door from said barrel when the assembly is driven to its second position.

5. The apparatus of claim 4 further comprising means for moving said assembly along a second path between raised and lowered positions.

6. A door handling apparatus forming part of a loading and unloading station for a plating barrel having a removable access door, comprising:

(a) an assembly mounted for motion along a first path towards and away from a barrel positioned in predetermined alignment with said assembly;

(b) drive means for driving said assembly between a first position, wherein said assembly is located adjacent said barrel access door and a second position spaced from said first position;

(c) door releasing means carried by said assembly and actuatable to release a door retaining means on said barrel access door, said door releasing means comprising at least one rotatable spindle including a clamping arrangement at one end, engageable with locking structure on said barrel door and operative to rotate said structure between locked and unlocked positions; and, (d) door holding means carried by said assembly operable to drip said access door when said assembly is in its first position thereby effecting separation of said door from said barrel when the assembly is driven to its second position.

7. The apparatus of claim 6 wherein said spindle and clamping arrangement forms part of said door holding means.

8. A loading and unloading station for a plating barrel having a rectangular opening, two sides of which are defined by a pair of spaced ribs extending lengthwise of said barrel, and a removable access door for said barrel opening, said access door comprising a perforate closure panel shaped to fit between said ribs to close the opening of said plating barrel, a pair of latch plates overlying the outer face of said closure panel and slidable toward and away from each other, locking knobs for releasably securing said latch plates to said closure panel, each latch plate including a plurality of rigid tongues spaced along opposite sides of said plates that project beyond the side edges of said closure panel, said locking tongues dimensioned to fit between adjacent lips formed on said ribs and engageable therewith when the latch plates are slid in a predetermined direction, and guide means for preventing skewed motion in said latch means, said loading and unloading station including a door handling apparatus, comprising:

(a) an assembly mounted for motion along a first path toward and away from said removable access door of said plating barrel when said barrel is positioned in predetermined alignment with said assembly;

(b) drive means for driving said assembly between a first position, wherein said assembly is located adjacent said barrel access door and a second position spaced from said first position;

(c) door releasing means carried by said assembly and actuatable to release said locking knobs and further actuatable to slide said latch plates to disengage said locking tongues from the adjacent lips formed on said ribs; and, (d) door holding means carried by said assembly operable to grip said access door when said assembly is in its first position thereby effecting separation of said door from said barrel when the assembly is driven to its second position.

9. A loading and unloading station for a plating barrel having a rectangular opening, two sides of which are defined by a pair of spaced ribs extending lengthwise of said barrel, and a removable access door for said barrel opening, said access door comprising a perforate closure panel shaped to fit between said ribs to close the opening of said plating barrel, and a plurality of resilient clamps mounted to and extending transversely across said access door and engageable with portions of said barrel ribs to secure said door to said barrel, said loading and unloading station including a door handling apparatus, comprising:

(a) an assembly supported for motion towards and away from said barrel access door when said barrel is positioned in predetermined alignment with said assembly;

(b) means for driving said assembly between a first position wherein said assembly is located adjacent to said barrel access door and a second position, spaced from said first position;

(c) spreader means carried by said door assembly engageable with said resilient clamps;

(d) said spreader means including means for spreading and releasing said clamps from said barrel ribs, said spreader means further operative to maintain engagement between said assembly and said access door to effect separation of said door from said barrel as said assembly is moved to its second position.

10. A door handling apparatus for a metal finishing barrel or the like, having a removable access door including a door retaining means, comprising:

(a) an assembly supported for motion towards and away from a barrel positioned in predetermined alignment with said handling apparatus;

(b) means for driving said assembly between a first position wherein said assembly is located adjacent to said barrel and a second position, spaced from said first position;

(c) a door releasing means carried by said assembly including a clamping arrangement mounted on one end of a rotatable spindle engageable with a door locking mechanism forming part of said door retaining means and operative to unlock said door locking mechanism; and, (d) said door releasing means further operative to maintain clamping engagement with said door locking mechanism as said assembly is driven to said second position, said door being held to said assembly by the engagement between said door locking mechanism and said clamping arrangement, whereby said door is separated from said metal finishing barrel.

11. The apparatus of claim 10 further comprising means supporting said assembly for motion along a second path.

12. The apparatus of claim 10 wherein said door releasing means includes means for moving a door latch plate between door locked and door unlocked positions.

13. The apparatus of claim 10 wherein said door releasing means includes means for releasing and removing door clamping devices used to secure the door to said plating barrel.

14. The apparatus of claim 10 further comprising a barrel support structure for supporting said barrel in an aligned relationship with said assembly.

15. The apparatus of claim 14 wherein said support structure additionally includes means for rotating said barrel between said aligned position and a load position rotatably spaced from said aligned position.

16. The apparatus of claim 4 wherein said barrel supporting means includes a drive means for rotating said barrel between said aligned position and a barrel dumping position.

17. The apparatus of claim 4 wherein said spindle is rotated by a fluid pressure operated actuator and associated control system, said control system including means for limiting the rotational torque of said spindle when engaging said door locking structure.

* * * * *